US007677621B1

(12) United States Patent
Guadalupe, Sr.

(10) Patent No.: US 7,677,621 B1
(45) Date of Patent: Mar. 16, 2010

(54) OIL-DISPENSING ASPHALT SHOVEL

(76) Inventor: Romardo L. Guadalupe, Sr., 215 Somerset Dr., Willingboro, NJ (US) 08046

( * ) Notice: Subject to any disclaimer, the term of this patent is extended or adjusted under 35 U.S.C. 154(b) by 918 days.

(21) Appl. No.: 11/456,478

(22) Filed: Jul. 10, 2006

(51) Int. Cl.
*A01B 1/02* (2006.01)

(52) U.S. Cl. ..... 294/49

(58) Field of Classification Search ..... 294/49, 294/54.5; 34/241; 15/415.1; 366/129, 349
See application file for complete search history.

(56) References Cited

U.S. PATENT DOCUMENTS

| | | | | |
|---|---|---|---|---|
| 243,098 | A * | 6/1881 | Becker et al. | 294/49 |
| 1,103,484 | A * | 7/1914 | Clarke | 294/49 |
| 1,747,258 | A * | 2/1930 | O'Neil | 294/49 |
| 3,143,984 | A | 8/1964 | Morasch | |
| 5,148,880 | A | 9/1992 | Lee et al. | |
| 5,161,308 | A | 11/1992 | Hayward | |
| 5,361,849 | A | 11/1994 | Moore | |
| 5,822,968 | A | 10/1998 | Savala | |
| 2008/0295364 | A1 * | 12/2008 | Nagamatsu et al. | 37/197 |

* cited by examiner

*Primary Examiner*—Paul T Chin
(74) *Attorney, Agent, or Firm*—Crossley Patent Law; Mark A. Crossley

(57) ABSTRACT

An oil-dispensing asphalt shovel for preventing asphalt from sticking to the blade-like member of the shovel. The shovel includes a blade-like member having a top end to which is attached a tubular oil dispensing member. The blade-like member has a plurality of holes being spaced along and extending through a side wall thereof, and has inlet ports extending through a side wall thereof and being diametrically opposed to the holes. A hollow shaft support member has a top end and a pair of leg portions securely attached to the tubular oil dispensing member. The leg portions have apertures extending through a bottom thereof and aligning with an inlet port of the tubular oil-dispensing member. The hollow shaft member has a first end to which is attached a handle member and a second end securely attached to and extended into the hollow shaft support member for storing oil with the hollow shaft member having an opening extending through a side wall and near the first end thereof, and also having an outlet port extending through the second end thereof with the opening being closeable with a plug. An oil dispensing assembly allows oil to be dispensed from the hollow shaft member to the dispensing member.

3 Claims, 3 Drawing Sheets

OIL-DISPENSING ASPHALT SHOVEL

BACKGROUND OF THE INVENTION

1. Field of the Invention

The present invention relates to a self-oiling asphalt shovel and more particularly pertains to a new oil-dispensing asphalt shovel for preventing asphalt from sticking to the blade-like member of the shovel.

2. Description of the Prior Art

The use of a self-oiling asphalt shovel is known in the prior art. More specifically, a self-oiling asphalt shovel heretofore devised and utilized are known to consist basically of familiar, expected and obvious structural configurations, notwithstanding the myriad of designs encompassed by the crowded prior art which have been developed for fulfillment of countless objectives and requirements. Known prior art includes U.S. Pat. No. 3,143,981; U.S. Pat. No. 5,822,968; U.S. Pat. No. 5,161,308; U.S. Pat. No. 5,361,849; U.S. Pat. No. 5,148,880; and U.S. Pat. No. Des. 355,819. While these devices fulfill their respective, particular objectives and requirements, the aforementioned patents do not disclose an oil-dispensing asphalt shovel. The inventive device includes a blade-like member having a top end, and also includes a tubular oil dispensing member being securely attached to and along the top end of said blade-like member and having a plurality of holes being spaced along and extending through a side wall thereof, and also having inlet ports extending through a side wall thereof and being diametrically opposed to the holes; and further includes a hollow shaft support member having a top end and having a pair of leg portions which are securely attached to the tubular oil dispensing member with the leg portions having apertures extending through a bottom thereof with each aperture being in alignment with a respective inlet port of the tubular oil dispensing member; and also includes a hollow shaft member having a first end and a second end which is securely attached to and extended into the hollow shaft support member for storing oil with the hollow shaft member also having an opening extending through a side wall and near the first end thereof, and also having an outlet port extending through the second end thereof with the opening being closeable with a plug; and further includes a handle member being securely attached to the first end of said hollow shaft member; and an oil dispensing assembly for allowing oil to be dispensed from said hollow shaft member to the tubular dispensing member. In these respects, the oil-dispensing asphalt shovel according to the present invention substantially departs from the conventional concepts designs of the prior art, and in so doing provides an apparatus primarily developed for the purpose of preventing asphalt from sticking to the blade-like member of the shovel.

SUMMARY OF THE INVENTION

In view of the foregoing disadvantages inherent in the known types of self oil asphalt shovel now present in the prior art, the present invention provides a new oil-dispensing asphalt shovel construction wherein the same can be utilized for preventing asphalt from sticking to the blade-like member of the shovel. The general purpose of the present invention, which will be described subsequently in detail, is to provide a new dispensing asphalt shovel which has many of the advantages of the self oil asphalt shovel mentioned heretofore and many novel features that result in a new oil-dispensing asphalt shovel which is not anticipated, rendered obvious, suggested, or even implied by any of the prior art self oil asphalt shovel, either alone or in any combination thereof.

To attain this, the present invention generally comprises a blade-like member having a top end; and also includes a tubular oil dispensing member being securely attached to and along the top end of said blade-like member and having a plurality of holes being spaced along and extending through a side wall thereof, and also having inlet ports extending through a side wall thereof and being diametrically opposed to the holes; and further includes a hollow shaft support member having a top end and having a pair of leg portions which are securely attached to the tubular oil dispensing member with the leg portions having apertures extending through a bottom thereof with each aperture being in alignment with a respective inlet port of the tubular oil dispensing member; and also includes a hollow shaft member having a first end and a second end which is securely attached to and extended into the hollow shaft support member for storing oil with the hollow shaft member also having an opening extending through a side wall and near the first end thereof, and also having an outlet port extending through the second end thereof with the opening being closeable with a plug; and further includes a handle member being securely attached to the first end of said hollow shaft member; and an oil dispensing assembly for allowing oil to be dispensed from said hollow shaft member to the tubular dispensing member.

Thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Further, the purpose of the foregoing abstract is to the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new oil-dispensing asphalt shovel which has many of the advantages of the self oil asphalt shovel mentioned heretofore and many novel features that result in a new oil-dispensing asphalt shovel which is not anticipated, rendered obvious, suggested, or even implied by any of the prior art self oil asphalt shovel, either alone or in any combination thereof.

It is another object of the present invention to provide a new oil-dispensing asphalt shovel which may be easily and efficiently manufactured and marketed.

It is a further object of the present invention to provide a new oil-dispensing asphalt shovel which is of a durable and reliable construction.

Even further object of the present invention is to provide a new oil-dispensing asphalt shovel which is susceptible of a low cost of manufacture with regard to both materials and labor, and which accordingly is then susceptible of low prices of sale to the consuming public, thereby making such oil-dispensing asphalt shovel economically available to the buying public.

Still yet another object of the present invention is to provide a new oil-dispensing asphalt shovel which provides in the apparatuses and methods of the prior art some of the advantages thereof, while simultaneously overcoming some of the disadvantages normally associated therewith.

Still another object of the present invention is to provide a new oil-dispensing asphalt shovel for preventing asphalt from sticking to the blade-like member of the shovel.

Yet another object of the present invention is to provide a new oil-dispensing asphalt shovel which includes a blade-like member having a top end; and also includes a tubular oil dispensing member being securely attached to and along the top end of said blade-like member and having a plurality of holes being spaced along and extending through a side wall thereof, and also having inlet ports extending through a side wall thereof and being diametrically opposed to the holes; and further includes a hollow shaft support member having a top end and having a pair of leg portions which are securely attached to the tubular oil dispensing member with the leg portions having apertures extending through a bottom thereof with each aperture being in alignment with a respective inlet port of the tubular oil dispensing member; and also includes a hollow shaft member having a first end and a second end which is securely attached to and extended into the shaft support member for storing oil with the hollow shaft member also having an opening extending through a side and near the first end thereof, and also having an outlet port extending through the second end thereof with the opening being closeable with a plug; and further includes a handle member being securely attached to the first end of said hollow shaft member; and an oil dispensing assembly for allowing oil to be dispensed from said hollow shaft member to the tubular dispensing member.

Still yet another object of the present invention is to provide a new oil-dispensing asphalt shovel that saves the user substantial time by not having to take time to clean off the blade-like member of the shovel during the use thereof.

Even still another object of the present invention is to provide a new oil-dispensing asphalt shovel that reduces mess and is easy and convenient to use without adding excess weight to the shovel.

These together with other objects of invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
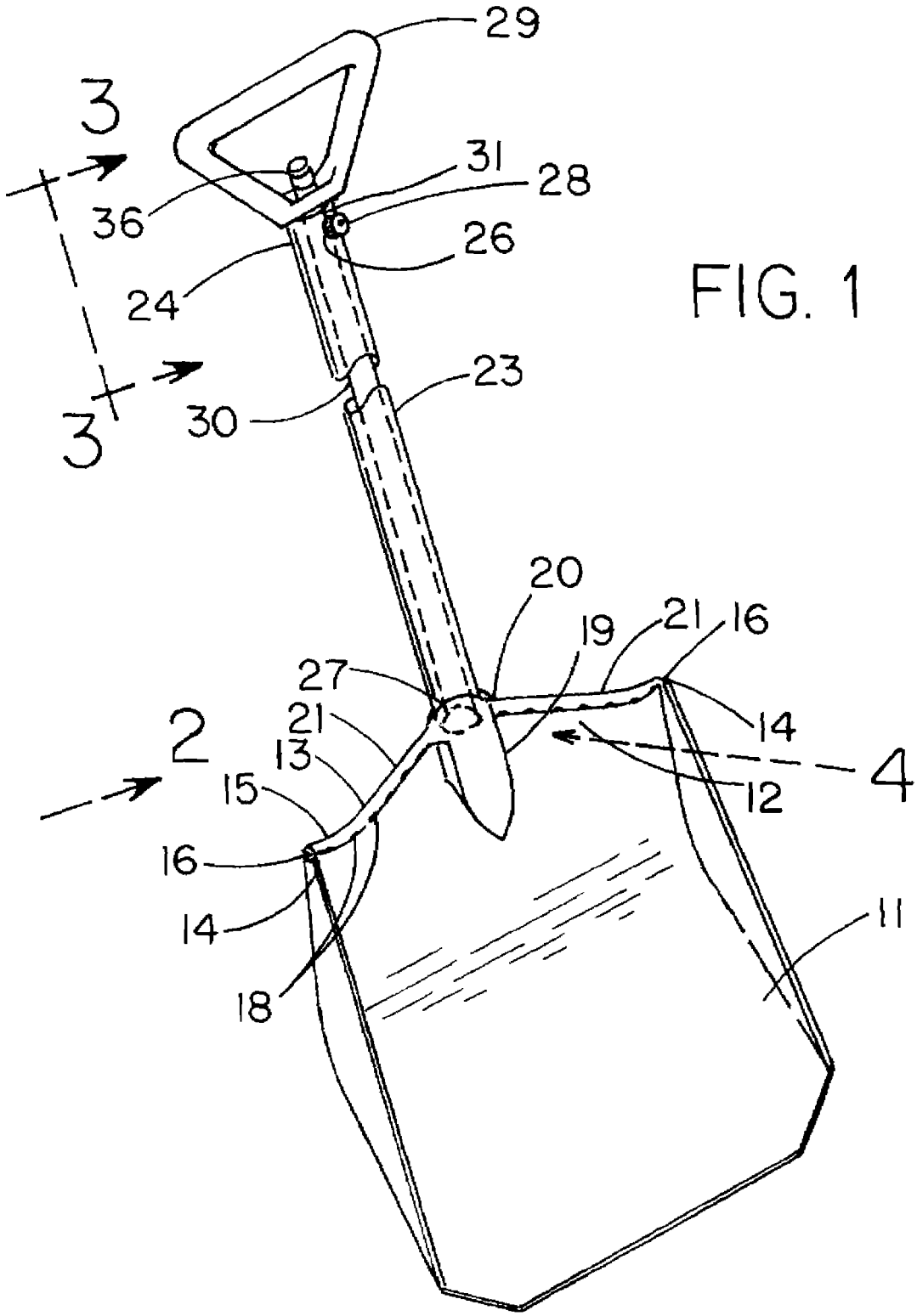
FIG. 1 is a perspective view of a new oil-dispensing asphalt shovel according to the present invention.
Figure 3:
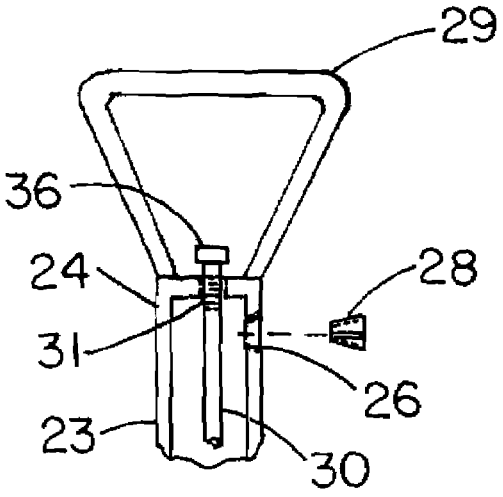
FIG. 3 is a cross-sectional view of the upper portion of the hollow shaft member of the present invention.
Figure 2:
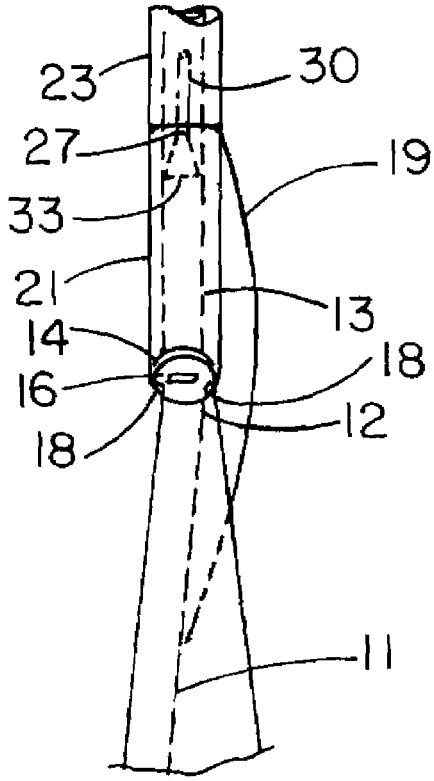
FIG. 2 is a side elevation view of the blade-like member and the tubular oil dispensing member of the present invention.
Figure 4:
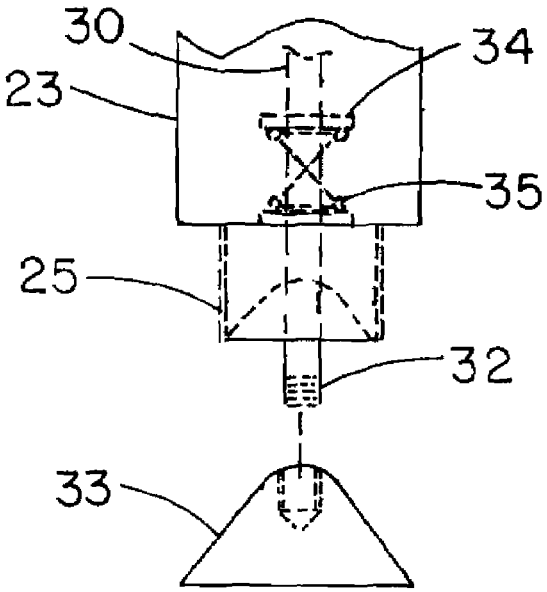
FIG. 4 is a cross-sectional view of the lower portion of the hollow shaft of the present invention.
Figure 5:
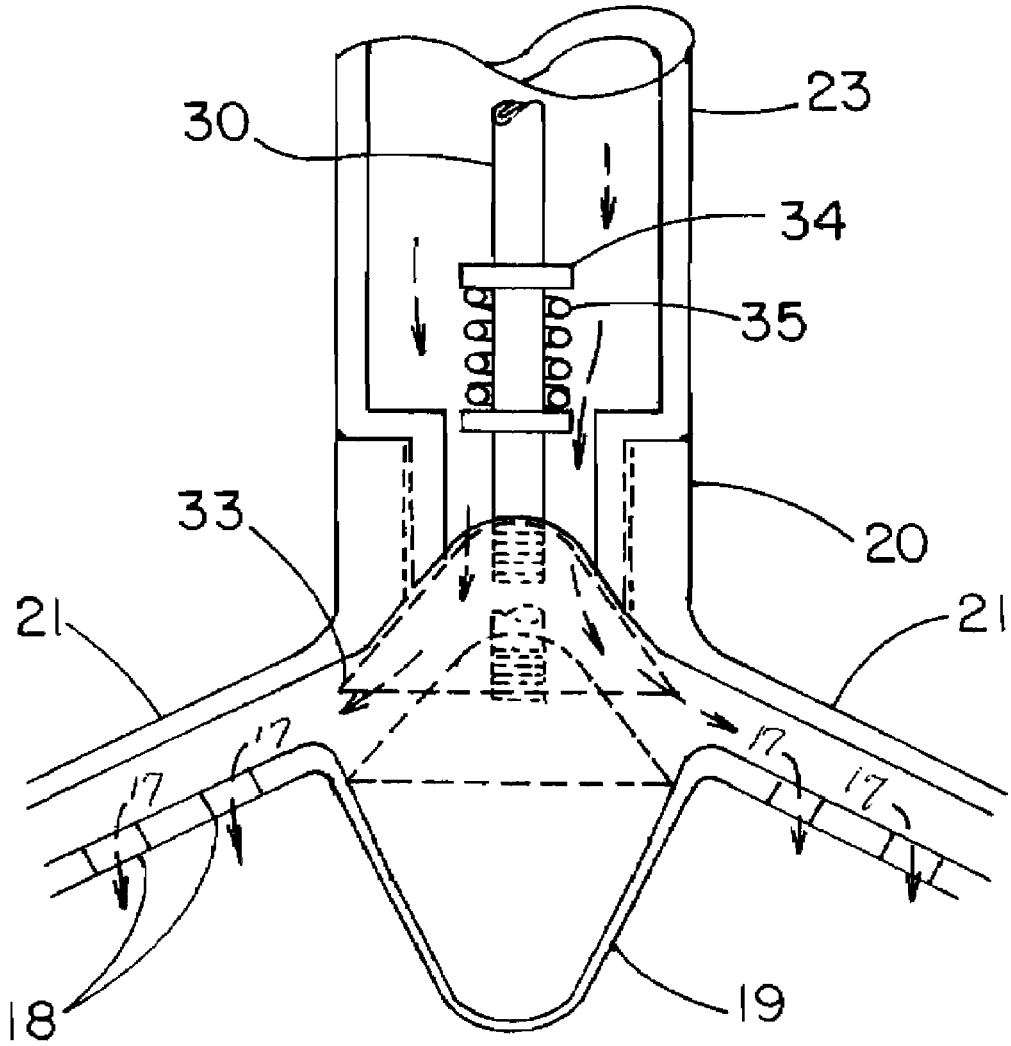
FIG. 5 is a cross-sectional view of the handle support member and the tubular oil dispensing member of the present invention.

With reference now to the drawings, and in particular to FIGS. 1 through 5 thereof, a new oil-dispensing asphalt shovel embodying the principles and concepts of the present invention and generally designated by the reference numeral 10 will be described.

As best illustrated in FIGS. 1 through 5, the oil-dispensing asphalt shovel 10 generally comprises a blade-like member having a top end 12. A tubular oil dispensing member 13 is securely and conventionally attached to and along the top end 12 of the blade-like member 11 and has a plurality of holes 18 being spaced along and extending through a side wall 15 thereof, and also has inlet ports 17 extending through the side wall 15 thereof and being diametrically opposed to the holes or apertures 18. The tubular oil dispensing 13 is essentially disposed lengthwise upon the top end 12 of the blade-like member 11 with the holes or apertures 18 in the tubular oil-dispensing member 13 being disposed adjacent and proximate to where the tubular oil-dispensing member 13 is securely attached to the blade-like member 11. The holes or apertures 18 are adapted to dispense oil upon a substance carrying side of the blade-like member 11. The tubular oil-dispensing member 13 includes open ends 14 and end caps 16 which are closeable over the open ends 14.

A hollow shaft support member 19 has top end 20 and has a pair of leg portions 21 which are securely and conventionally attached and welded to the tubular oil dispensing member 13. The leg portions 21 have apertures or holes 18 extending through a bottom thereof with each aperture or hole 18 being in alignment with a respective inlet port 17 of the tubular oil dispensing member 13.

A hollow shaft member 23 has a first end 24 and a second end 25 which is securely and conventionally attached to and threadingly extended into the hollow shaft support member 19 for storing oil. The hollow shaft member 23 also has an opening 26 extending through a side wall and near the first end 24 thereof, and also has an outlet port 27 extending through the second end 25 thereof with the opening 26 being closeable with a plug member 28.

A handle member 29 is securely and conventionally attached to the first end 14 of the hollow shaft member 23. An oil dispensing means for allowing oil to be dispensed from the hollow shaft member 23 to the tubular dispensing member includes an elongate plug support member 30 having a first end 31 and a second end 32 and being movably disposed within the hollow shaft member 23, and also includes a plug 33 being securely and conventionally attached to the second end 32 of the elongate plug support 30 and being removably seated in the outlet port 28 of the hollow shaft member 23, and further includes a stop member 34 securely and conventionally mounted to the elongate plug support member 30 and being spaced from the second end 32 thereof, and also includes a spring member 35 being conventionally disposed about the elongate plug support member 30 between the second end 25 of the hollow shaft member 23 and the stop member 34 for biasing the plug 33 into closing the outlet port 28, and further includes a knob member 36 securely and conventionally attached to the first end 31 of the elongate plug support member 30 for a user to push upon to remove the plug 33 from the outlet port 28 to release oil to the hollow shaft support member 19. The first end 31 of the elongate plug support member 30 is movably extended through a first end 24 of the hollow shaft member 23. The second end 32 of the elongate plug support member 30 retractably extends through the outlet port 28 of the hollow shaft member 23.

In use, the user fills the hollow shaft member 23 with oil by pouring oil into the hollow shaft member 23 through the opening 26. To dispense oil onto the blade-like member 11, the user pushes down upon the knob member 36 to move the elongate plug support member 30 which unseats the plug 33 from the outlet port 28 which allows the oil to drain through the outlet port 28 and through the leg portions 21 of the shaft support member 19 and through the tubular oil dispensing member 13 and through the holes 18 therein and onto the substance carrying side of the blade-like member 11. To close the outlet port 28, the user simply releases the knob member 36 with the spring member 35 urging the 33 into the outlet port 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An oil-dispensing asphalt shovel comprising:

a blade-like member having a top end;

a tubular oil dispensing member being securely attached to and along said top end of said blade-like member and having a plurality of holes being spaced along and extending through a side wall thereof, and also having inlet ports extending through said side wall thereof and being diametrically opposed to said holes;

a hollow shaft support member having a top end and having a pair of leg portions which are securely attached to said tubular oil dispensing member, said leg portions having apertures extending through a bottom thereof with each said aperture being in alignment with a respective said inlet port of said tubular oil dispensing member;

a hollow shaft member having a first end and a second end which is securely attached to and extended into said hollow shaft support member for storing oil, said hollow shaft member also having an opening extending through a side wall and near said first end thereof, and also having an outlet port extending through said second end thereof, said opening being closeable with a plug;

a handle member securely attached to said first end of said hollow shaft member;

an oil dispensing means for allowing oil to be dispensed from said hollow shaft member to said tubular dispensing member;

wherein said tubular oil dispensing member is essentially disposed lengthwise upon said top end of said blade-like member;

wherein said holes in said tubular oil-dispensing member are disposed adjacent and proximate to where said tubular dispensing member is securely attached to said blade-like member, said holes being adapted to dispense oil upon a substance carrying side of said blade-like member;

wherein said tubular oil-dispensing member includes open ends which are closeable with end caps;

wherein said oil dispensing means includes an elongate plug support member having a first end and a second end and being movably disposed within said hollow shaft member, and includes a plug being securely attached to said second end of said elongate plug support member and being removably seated in said outlet port of said hollow shaft member, and further includes a stop member securely mounted to said elongate plug support member and being spaced from said second end thereof, and also a spring member being disposed about said elongate plug support member between said second end of said hollow shaft member and said stop for biasing said plug into closing said outlet port. and includes a knob member securely attached to said first end of said elongate plug support member for a user to push upon to remove said plug from said outlet port to release oil to said hollow shaft support member.

2. An oil-dispensing asphalt shovel as described in claim 1, wherein said second end of said elongate plug support member retractably extends through said outlet port of said hollow shaft member, said first end of said elongate plug support member being movably extended through a first end of said hollow shaft member.

3. An oil-dispensing asphalt shovel comprising:

a blade-like member having a top end;

a tubular oil dispensing member being securely attached to and along said top end of said blade-like member and having a plurality of holes being spaced along and extending through a side wall thereof, and also having inlet ports extending through said side wall thereof and being diametrically opposed to said holes, said tubular oil dispensing member being essentially disposed lengthwise upon said top end of said blade-like member, said holes in said tubular oil-dispensing member being disposed adjacent and proximate to where said tubular oil-dispensing member is securely attached to said blade-like member, said holes being adapted to dispense oil upon a substance carrying side of said blade-like member, said tubular oil-dispensing member including open ends and end caps which are closeable over said open ends;

a hollow shaft support member having a top end and having a pair of leg portions which are securely attached to said tubular oil dispensing member, said leg portions having apertures extending through a bottom thereof with each said aperture being in with a respective said inlet port of said tubular oil dispensing member;

a hollow shaft member having a first end and a second end which is securely attached to and extended into said hollow shaft support member for storing oil, said hollow shaft member also having an opening extending through a side wall and near said first end thereof, and also having an outlet port extending through said second end thereof, said opening being closeable with a plug;

a handle member securely attached to said first end of said hollow shaft member; and an oil dispensing means for allowing oil to be dispensed from said hollow shaft member to said tubular dispensing member including an elongate plug support member having a first end and a second end and being movably disposed within said hollow shaft member, and also including a plug being securely attached to said second end of said elongate plug support member and being removably seated in said outlet port of said hollow shaft member, and further including a stop member securely mounted to said elongate plug support member and being spaced from said second end thereof, and also including a spring member being disposed about said elongate plug support member between said second end of said hollow shaft member and said stop member for biasing said plug into closing said outlet port, and further including a knob member securely attached to said first end of said elongate plug support member for a user to push upon to remove said plug from said outlet port to release oil to said hollow shaft support said second end of said elongate plug support member retractably extending through said outlet port of said hollow shaft member, said first end of said elongate plug support member being movably extended through a first end of said hollow shaft member.

* * * * *